US007369098B2

(12) United States Patent
Chen

(10) Patent No.: US 7,369,098 B2
(45) Date of Patent: May 6, 2008

(54) COMPACT MULTI-TIERED PLATE ANTENNA ARRAYS

(75) Inventor: Zhining Chen, Singapore (SG)

(73) Assignee: Agency for Science Technology and Research, Singapore (SG)

( * ) Notice: Subject to any disclaimer, the term of this patent is extended or adjusted under 35 U.S.C. 154(b) by 0 days.

(21) Appl. No.: 10/598,408

(22) PCT Filed: Jan. 20, 2005

(86) PCT No.: PCT/SG2005/000014

§ 371 (c)(1),
(2), (4) Date: Jun. 5, 2007

(87) PCT Pub. No.: WO2005/071789

PCT Pub. Date: Aug. 4, 2005

(65) Prior Publication Data

US 2007/0273607 A1 Nov. 29, 2007

(30) Foreign Application Priority Data

Jan. 26, 2004 (SG) ..... 200400539

(51) Int. Cl.
*H01Q 21/00* (2006.01)
*H01Q 1/36* (2006.01)

(52) U.S. Cl. ..... 343/893; 343/700 MS; 343/848; 343/824

(58) Field of Classification Search ..... 343/700 MS, 343/824, 848, 846, 893, 829, 853
See application file for complete search history.

(56) References Cited

U.S. PATENT DOCUMENTS 4,763,131 A 8/1988 Rosser
4,816,835 A * 3/1989 Abiko et al. ..... 343/700 MS
5,465,100 A * 11/1995 Remondiere et al. ..... 343/769
5,604,505 A 2/1997 Matterer
5,796,372 A * 8/1998 Elliot ..... 343/797
5,995,055 A 11/1999 Milroy
6,320,547 B1 * 11/2001 Fathy et al. ..... 343/700 MS
6,384,788 B2 * 5/2002 Pretorius et al. ..... 343/700 MS
6,657,592 B2 * 12/2003 Dening et al. ..... 343/700 MS
6,795,020 B2 * 9/2004 Sreenivas et al. .... 343/700 MS

OTHER PUBLICATIONS

International Search Report for PCT/SG2005/000014, dated Apr. 7, 2005.

* cited by examiner

*Primary Examiner*—Douglas W. Owens
*Assistant Examiner*—Chuc Tran
(74) *Attorney, Agent, or Firm*—Conley Rose, P.C.

(57) ABSTRACT

An antenna array having a plurality of array elements is disclosed. The antenna array comprises a first array element (204A) having a first suspended radiator (207A) and a first ground conductor (206A), the first suspended radiator being displaced from the first ground conductor. The antenna also comprises a second array element (204B) being adjacent to the first array element, the second array element having a second suspended radiator (207B) and a second ground conductor (206B), wherein the second suspended radiator is displaced from the second ground conductor. In the antenna the first ground conductor is adjacent to and displaced from the second ground conductor and the first ground conductor is disposed on a first tier and the second ground conductor is disposed on a second tier to form an at least two-tiered ground conductor.

13 Claims, 3 Drawing Sheets

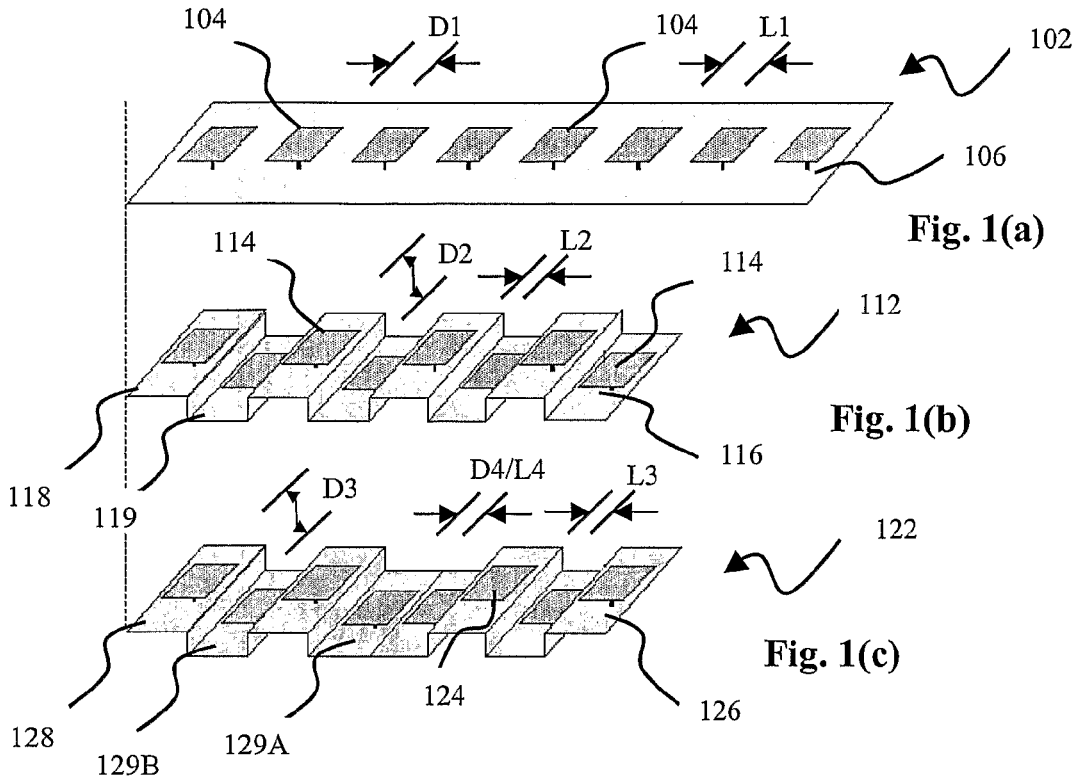
Fig. 1(a)
Fig. 1(b)
Fig. 1(c)
Fig. 2(a)
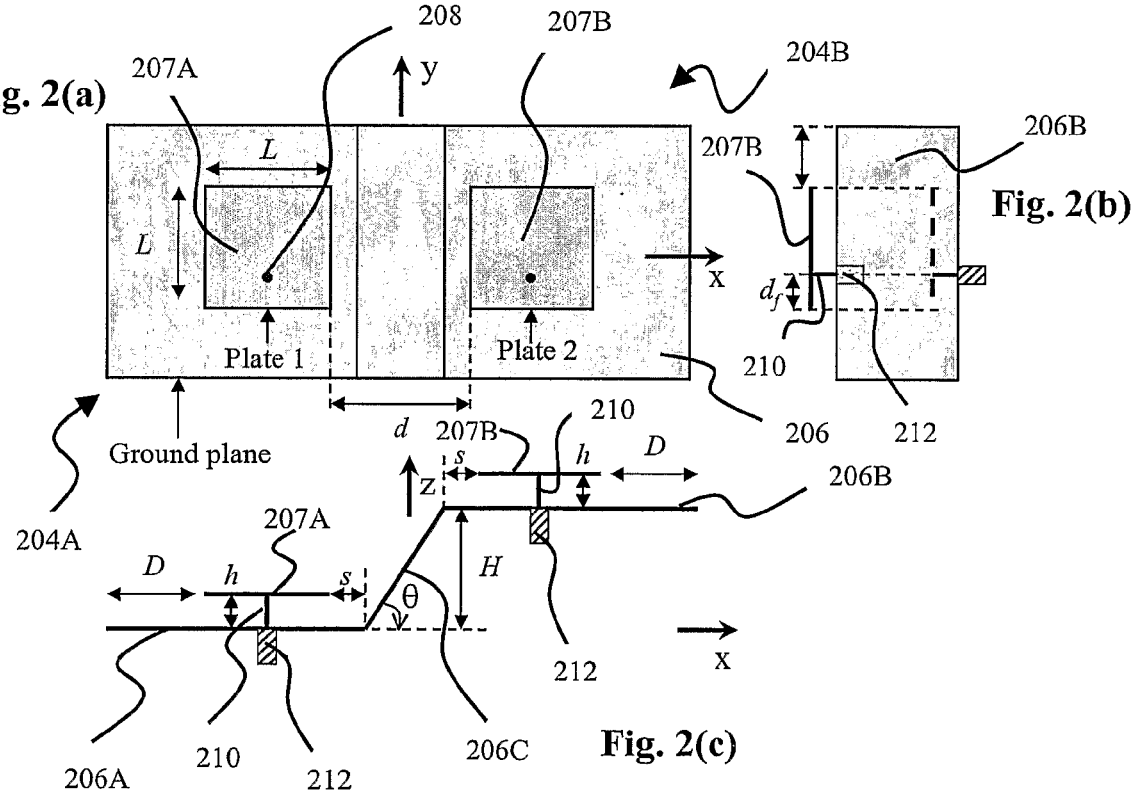
Fig. 2(b)
Fig. 2(c)

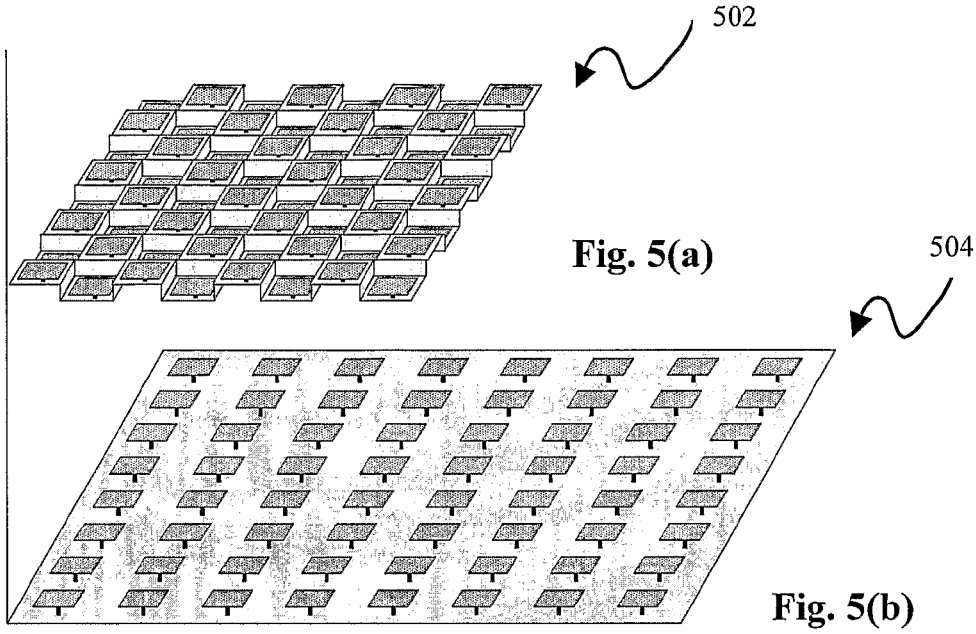
Fig. 5(a)
Fig. 5(b)
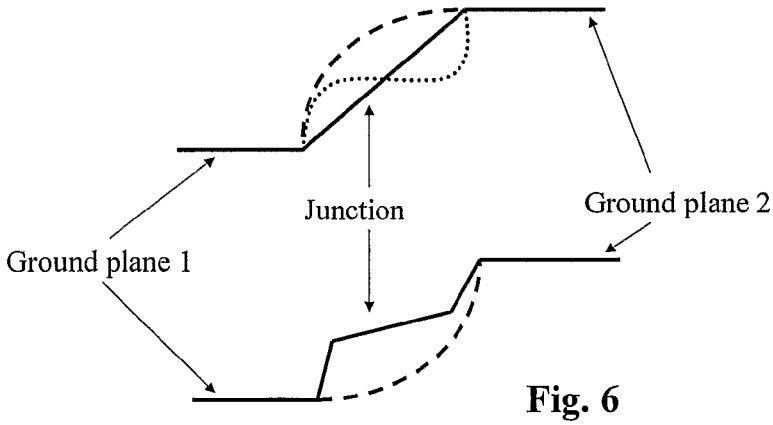
Fig. 6
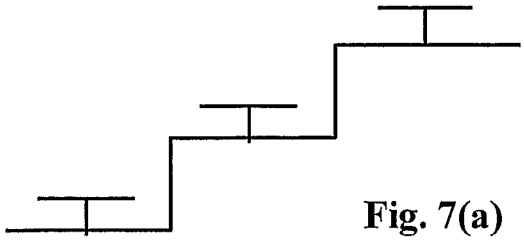
Fig. 7(a)
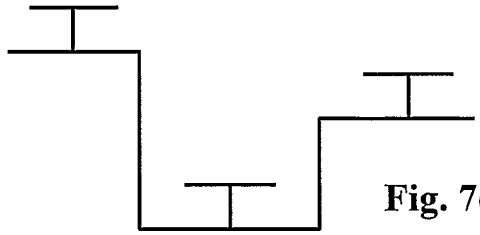
Fig. 7(b)

COMPACT MULTI-TIERED PLATE ANTENNA ARRAYS

FIELD OF INVENTION

The invention relates generally to antenna arrays. In particular, it relates to antenna arrays with array elements with a multi-tiered ground conductor.

BACKGROUND

Mutual coupling between array elements of antenna arrays significantly affect the performances of these arrays in wireless communications applications. The affected performances include signal-to-interference-pulse-noise ratio (SINR) and direction-of-arrival (DOA) estimation in the case of an adaptive array.

Therefore during the design of antenna arrays the problem of mutual coupling is an important consideration. Mutual coupling also adversely determines the dimensions of the arrays in addition to affecting the foregoing performances of the arrays.

Typically, mutual coupling may degrade the radiation patterns for the arrays due to the increase in side lobe levels, the shift of nulls, and the appearance of grating lobes.

Mutual coupling in plate antenna arrays is mainly attributed to space waves, higher-order waves, surface waves, and leaky waves. Generally for conventional plate antenna arrays with a common planar ground conductor, enlarging the spacing between plate array elements, or inter-element spacing, results in reducing or weakening mutual coupling. However, the larger inter-element spacing results in a larger lateral size of the arrays. The larger lateral size of the arrays leads to higher installation cost of wireless communications systems in which such arrays are applied.

There is therefore a need for a laterally compact plate antenna array configured appropriately for reducing mutual coupling between plate array elements.

SUMMARY

Embodiments of the invention are disclosed hereinafter for reducing the lateral size of an antenna array with reduced or weak mutual coupling by using a multi-tiered configuration. In particular, a common ground conductor, typically planar and single-tiered in a conventional antenna array, is multi-tiered by folding or corrugation to reduce the lateral spacing between plate array elements while maintaining the inter-element spacing.

In accordance with one aspect of the invention, there is disclosed an antenna array having a plurality of array elements, the antenna array comprising a first array element having a first suspended radiator and a first ground conductor, the first suspended radiator being displaced from the first ground conductor. The antenna also comprises a second array element being adjacent to the first array element, the second array element having a second suspended radiator and a second ground conductor, wherein the second suspended radiator is displaced from the second ground conductor. In the antenna array the first ground conductor is adjacent to and displaced from the second ground conductor and the first ground conductor is disposed on a first tier and the second ground conductor is disposed on a second tier to form an at least two-tiered unitary ground conductor.

In accordance with another aspect of the invention, there is disclosed a method for configuring an antenna array having a plurality of array elements, the method comprising the steps of providing a first array element having a first suspended radiator and a first ground conductor, the first suspended radiator being displaced from the first ground conductor, and providing a second array element as adjacent to the first array element, the second array element having a second suspended radiator and a second ground conductor, wherein the second suspended radiator is displaced from the second ground conductor. The method also comprises the steps of disposing the first ground conductor adjacent to and displaced from the second ground conductor, and disposing the first ground conductor on a first tier and the second ground conductor on a second tier to form an at least two-tiered unitary ground conductor.

BRIEF DESCRIPTION OF DRAWINGS

Embodiments of the invention are described in detail hereinafter with reference to the drawings, in which:

FIG. 1(*a*) is an isometric view of a conventional plate antenna array with plate array elements and a planar ground conductor, and FIGS. 1(*b*) and (*c*) are isometric views of two plate antenna arrays according to embodiments of the invention with plate array elements and corrugated ground conductors, whereby the lateral size of the plate antenna arrays is compared with the lateral size of the conventional plate antenna array of FIG. 1(*a*);

FIGS. 2(*a*), (*b*) and (*c*) are respectively front elevation, side elevation and bottom views of adjacent plate array elements in a plate antenna array with a two-tiered ground conductor according to an embodiment of the invention;

FIG. 5(*a*) is an isometric view of a rectangular plate antenna array according to an embodiment of the invention with rectangular plate array elements and a two-tiered, two-dimensionally corrugated ground conductor, and FIG. 5(*b*) is an isometric view of a conventional plate antenna array with rectangular play array elements and a planar ground plate, in which the lateral size of the rectangular plate antenna array of FIG. 5(*a*) is compared with the lateral size of the conventional rectangular plate antenna array;

FIG. 6 is an illustration of variations of the two-tiered ground conductor of FIG. 2(*c*); and FIGS. 7(*a*) and 7(*b*) are illustrations of plate antenna arrays with multi-tiered ground conductors according to embodiments of the invention.

DETAILED DESCRIPTION

Figure 3:
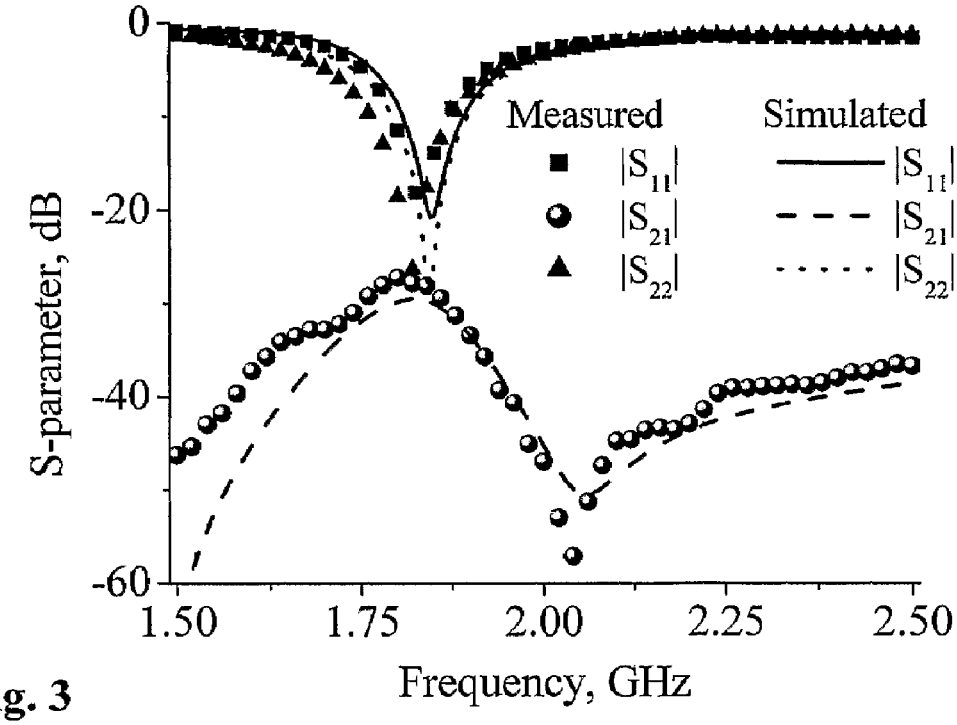
FIGS. 3 and 4 are plotted results of an investigation performed on the plate antenna array of FIG. 2(*a*)

Embodiments of the invention are described hereinafter with reference to the drawings for addressing the need for a laterally compact antenna array configured appropriately for reducing mutual coupling between array elements.

FIG. 1(*a*) shows the geometry of a conventional rectangular plate antenna array 102 with plate array elements 104 arranged in a single row along the length of the conventional rectangular plate antenna array 102. The conventional rectangular plate antenna array 102 also includes a rectangular and single-tiered common ground conductor 106.

Each plate array element 104 comprises a suspended plate radiator and a corresponding ground patch, the ground patch being part of the common ground conductor 106. The suspended plate radiator is fed with signals through conventional feeding means.

Each plate array element 104 is also spaced apart from a nearest adjacent plate array element 104 by the distance D1, known hereinafter as inter-element spacing D1. In this case the inter-element spacing D1 is equivalent to lateral spacing L1, which is spacing between nearest adjacent plate array elements 104 projected onto a plane parallel to the plane of the common ground conductor 106.

FIGS. 1(*b*) and 1(*c*) show two rectangular plate antenna arrays 112 and 122, respectively, according to two different embodiments of the invention, which have smaller lateral sizes than the conventional rectangular plate antenna array 102 shown in FIG. 1(*a*). The plate antenna array 112 as shown in FIG. 1(*b*) includes plate array elements 114 arranged in a single row along the length of the rectangular plate antenna array 112. The rectangular plate antenna array 112 also includes a rectangular and two-tiered common ground conductor 116 folded or corrugated longitudinally into alternating ridges 118 and grooves 119 of uniform widths. The ridges 118 are disposed on a same plane and form a higher tier or level with the corresponding plate array elements 114 while the grooves 119 are also disposed on a same plane and form a lower tier or level with the corresponding plate array elements 114.

Each plate array element 114 comprises a suspended plate radiator and a corresponding ground patch, the ground patch being plate-like and part of the common ground conductor 116. The suspended plate radiator is fed with signals through conventional feeding means.

Since the common ground conductor 116 is corrugated, inter-element spacing D2 is greater than lateral spacing L2 in relation to two nearest adjacent plate array elements 114. By having the inter-element spacing D2 being substantially equivalent to the inter-element spacing DI in the conventional rectangular plate antenna array 102, mutual coupling between the plate array elements 114 in this case is not worsened or increased, This is true even though the lateral spacing L2 is smaller than the lateral spacing L1 in the conventional rectangular plate antenna array 102.

The plate antenna array 122 as shown in FIG. 1(*c*) includes plate array elements 124 arranged in a single row along the length of the rectangular plate antenna array 122 and has a symmetrical structure. The rectangular plate antenna array 122 also includes a rectangular and two-tiered common ground conductor 126 folded or corrugated longitudinally into alternating ridges 128 and grooves 129A and 129B, the grooves 129A and 129B not being of uniform widths, Specifically as shown in FIG. 1(*c*), in the middle of the rectangular plate antenna array 122 the central groove 129A is wider than the side grooves 129B as in the central groove 129A two plate array elements 124 are disposed. The ridges 128 are disposed on a same plane and form a higher tier or level with the corresponding plate array elements 124 while the grooves 129A and 129B are also disposed on a same plane and form a lower tier or level with the corresponding plate array elements 124.

Each plate array element 124 comprises a suspended plate radiator and a corresponding ground patch, the ground patch being plate-like and forming part of the common ground conductor 126. The suspended plate radiator is fed with signals through conventional feeding means.

Since the common ground conductor 126 is corrugated, inter-element spacing D3 between plate array elements 124, other than those disposed in the central groove, is greater than lateral spacing L3 in relation to two nearest adjacent plate array elements 124. By having the inter-element spacing D3 being substantially equivalent to the inter-element spacing D1 in the conventional rectangular plate antenna array 102, mutual coupling between the plate array elements 124 in this case is not worsened or increased. This is true even though the lateral spacing L3 is smaller than the lateral spacing L1 in the conventional rectangular plate antenna array 102. In the case of the two plate array elements 124 in the central groove 129A, inter-element spacing D4 and lateral spacing L4 are equivalent, and may also be equivalent to the inter-element spacing D1 and lateral spacing L1, respectively.

FIGS. 2(*a*), 2(*b*) and 2(*c*) show geometrical and structural details of a rectangular plate antenna array 202 and two square plate array elements 204A and 204B therein according to an embodiment of the invention. Such an embodiment is constructed for investigation purposes, with reference to a coordinate system with X, Y and Z axes used for plotting results derived from the investigation, and forms a basic cell or unit from which larger plate antenna arrays according to the embodiments of the invention are formed. The investigation is therefore for providing results that are used hereinafter for substantiating design functionality and feasibility of the embodiments of the invention.

The rectangular plate antenna array 202 includes plate array elements 204A and 204B that are arranged adjacently along the length of the rectangular plate antenna array 202. The rectangular plate antenna array 202 also includes a rectangular and two-tiered common ground conductor 206 folded longitudinally into three planar and plate-like ground patches 206A, 206B and 206C that are continuous and preferably unitary. The ground patches 206A and 206B form lower and higher tiers, respectively, and ground patch 206C is a junction ground patch which connect the ground patches 206A and 206B located on different tiers.

Each plate array element 204A and 204B comprises a suspended plate radiator 207A and 207B and the corresponding ground patches 206A and 206B, respectively. The suspended plate radiators 207A and 207B are fed with signals through feed points 208 via conventional feeding means. In this case the plate array elements 204A and 204B are fed via conventional means using coaxial probes 210 through surface mounted adapters (SMAs) 212. The feed point 208 locations and heights of the suspended plate radiators 207A and 207B above the corresponding ground patches 206A and 206B, respectively, are determined for good impedance matching.

The junction ground patch 206C is inclined at an angle θ. The plate array element 204B is located at a height H above the plate array element 204A, and each of the suspended plate radiators 207A and 207B is located at a height h above the corresponding ground patches 206A and 206B, respectively.

Figure 4:
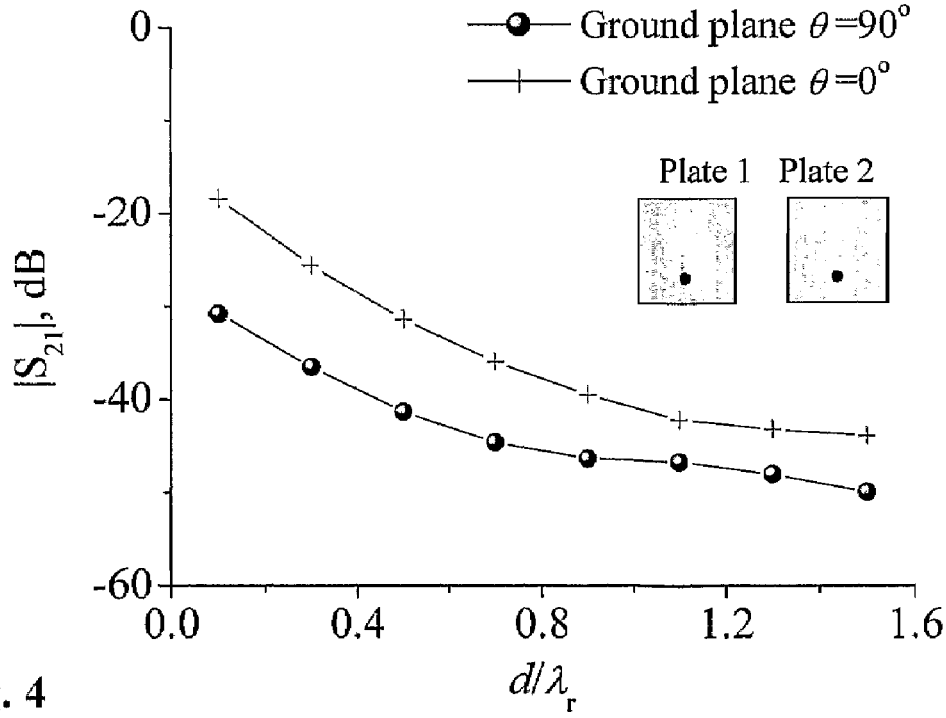

FIG. 3 shows the comparison between measured and simulated S parameters in relation to rectangular plate antenna array 202, in which good correlation between measurement and simulation is obtained. The comparison of mutual coupling for the cases with a flat common ground conductor 206 (θ=0°) and a step-like common ground conductor 206 (θ=90°), where distance d=2 s is varied, is shown in FIG. 4. Mutual coupling in the case of the step-like common ground conductor 206 is weaker by greater than 10 dB than mutual coupling in the case of the flat common ground conductor 206 even for the smallest lateral distance d. For the step-like ground conductor 206, the distance between such elements are much larger than the inter-element distance d due to the height H being preferably approximately $0.5\lambda_\tau$, where $\lambda_\tau$ is the operating wavelength in free space.

FIGS. 5(*a*) and 5(*b*) show a two-tiered, two-dimensionally corrugated plate antenna array 502 according to a further embodiment of the invention and a conventional planar plate antenna array 504, respectively. Array elements of these arrays may be other types of radiators, such as microstrip patch antennas, tapered slot monopoles, or monopoles. The inclined angle of junction ground patches can vary from 0 to 90°.

The anticipated reduction in the lateral size of the two-tiered, two-dimensionally corrugated plate antenna array in relation to conventional planar plate antenna arrays, both of which are square, while maintaining the same inter-element spacing, may be greater than 51% of the total lateral area or greater than 30% of each lateral dimension.

Embodiments of the invention may be applied advantageously to antenna array applications, in particular, large-scale military phased arrays and commercial adaptive arrays and multiple-input-multiple-output subsystems. For example, the adaptive arrays presently and in the future may become very commonly used in wireless communications systems, such as 3G and beyond generations of cellular wireless communications systems. The reduced sizes and the suppressed mutual coupling benefits the antenna arrays and even systems with improvement in performances of the antenna arrays and the reduction in the installation space, resulting in low cost.

In the foregoing manner, a laterally compact plate antenna array configured appropriately for reducing mutual coupling between plate array elements is disclosed. Although only a number of embodiments of the invention are disclosed, it becomes apparent to one skilled in the art in view of this disclosure that numerous changes and/or modification can be made without departing from the scope and spirit of the invention. For example, radiators in antenna arrays may be constructed from perfectly electrically conducting sheets of any shapes, such as rectangles, triangles, ellipses, polygons, annuli, or wires. Radiators may be installed at any angle with respect to corresponding ground patches. Radiators may be fed using a coaxial line, a microstrip line, aperture coupling, or waveguides. Junctions between two nearest adjacent ground patches at different tiers connecting the same may be of any shape, such as S, concave, convex, or multiple-step as shown in FIG. 6. Common ground conductors may also be folded or corrugated to form multi-tiers as shown in FIG. 7, therefore providing for multi-tiered antenna arrays. Common ground conductors may be constructed from perfectly electrically conducting and dielectric materials, or printed circuit boards (PCB). Antenna arrays may be planar or conformal with curviform surfaces, each tier being planar or conformal with curviform surfaces.

The invention claimed is:

1. An antenna array having a plurality of array elements, the antenna array comprising:

a first array element having a first suspended radiator and a first ground conductor, the first suspended radiator being displaced from the first ground conductor; and a second array element being adjacent to the first array element, the second array element having a second suspended radiator and a second ground conductor, wherein the second suspended radiator is displaced from the second ground conductor, wherein the first ground conductor is adjacent to and displaced from the second ground conductor and the first ground conductor is disposed on a first tier and the second ground conductor is disposed on a second tier to form an at least two-tiered unitary ground conductor.

2. The antenna array as in claim 1, wherein the first array element is immediately adjacent to the second array element.

3. The antenna array as in claim 1, wherein the first ground conductor is continuous with the second ground conductor.

4. The antenna array as in claim 1, wherein the inter-element spacing between the first array element and the second array element is greater than the lateral spacing therebetween.

5. The antenna array as in claim 1, wherein the antenna array is a plate antenna array.

6. The antenna array as in claim 5, wherein each of the first and second array elements is a plate array element.

7. The antenna array as in claim 6, wherein each of the first and second ground conductors is a ground patch.

8. The antenna array as in claim 7, wherein the first ground patch is continuous with the second ground patch.

9. A method for configuring an antenna array having a plurality of array elements, the method comprising the steps of:

providing a first array element having a first suspended radiator and a first ground conductor, the first suspended radiator being displaced from the first ground conductor;

providing a second array element as adjacent to the first array element, the second array element having a second suspended radiator and a second ground conductor, wherein the second suspended radiator is displaced from the second ground conductor;

disposing the first ground conductor adjacent to and displaced from the second ground conductor; and disposing the first ground conductor on a first tier and the second ground conductor on a second tier to form an at least two-tiered unitary ground conductor.

10. The method as in claim 9, wherein the step of disposing the first ground conductor adjacent to and displaced from the second conductor includes disposing the first array element immediately adjacent to the second array element.

11. The method as in claim 9, further comprising the step of providing the first ground conductor as continuous with the second ground conductor.

12. The method as in claim 9, further comprising the step of providing the inter-element spacing between the first array element and the second array element as greater than the lateral spacing therebetween.

13. The method as in claim 9, further comprising the step of providing the antenna array as a plate antenna array.

* * * * *

UNITED STATES PATENT AND TRADEMARK OFFICE

CERTIFICATE OF CORRECTION

PATENT NO. : 7,369,098 B2
APPLICATION NO. : 10/598408
DATED : May 6, 2008
INVENTOR(S) : Zhining Chen It is certified that error appears in the above-identified patent and that said Letters Patent is hereby corrected as shown below:

On the front page of the patent, in the Foreign Application Priority Data (30), the foreign priority application number should include "-9" and appears as follows:

(30) Foreign Application Priority Data
Jan. 26, 2004 (SG) .....200400539-3

At the end of column 6, line 56, after claim 13, insert the following claims:

14. The method as in claim 13, comprising the step of providing each of the first and second array elements as a plate array element.

15. The method as in claim 14, comprising the step of providing each of the first and second ground conductors as a ground patch.

16. The method as in claim 15, comprising the step of providing the first ground patch as continuous with the second ground patch.

Signed and Sealed this

Fifth Day of August, 2008

JON W. DUDAS
*Director of the United States Patent and Trademark Office*